United States Patent [19]

Adamson

[11] Patent Number: 4,799,613

[45] Date of Patent: Jan. 24, 1989

[54] METHOD AND APPARATUS FOR SENSING THE PREFERRED SIDE OF GARMENT PORTIONS

[75] Inventor: Fletcher D. Adamson, Alexander City, Ala.

[73] Assignee: Russell Corporation, Alexander City, Ala.

[21] Appl. No.: 118,557

[22] Filed: Nov. 9, 1987

[51] Int. Cl.[4] ..... A41H 43/02

[52] U.S. Cl. ..... 223/39; 198/395; 198/399; 250/561

[58] Field of Search ..... 250/559, 561; 198/399, 198/401, 403, 395; 223/39; 112/126, 304; 209/597, 598

[56] References Cited

U.S. PATENT DOCUMENTS

| | | | |
|---|---|---|---|
| 3,554,354 | 1/1971 | Reid | 198/399 |
| 3,932,755 | 1/1976 | Sagawa | 250/559 X |
| 4,140,397 | 2/1979 | Gara | 250/561 X |
| 4,417,148 | 11/1983 | Otake | 250/561 |
| 4,727,989 | 3/1988 | Cotic et al. | 198/399 X |

*Primary Examiner*—Andrew M. Falik

*Attorney, Agent, or Firm*—Jennings, Carter, Thompson & Veal

[57] ABSTRACT

Apparatus for use in an automated garment making process detects whether a garment portion on a continuously moving conveyor is right side up by use of a photodetector. If the garment portion is not right side up, the photodetector signals a control unit which causes a flipper assembly to flip the garment portion over as it is discharged from the conveyor. The garment portion retains its original position relative to other garment portions on the conveyor and the conveyor does not stop.

20 Claims, 4 Drawing Sheets

2
36
13
14
3
18
22
19
22
18
22
22
4
3
19
22
26
13
42
21
22
26
26
22
27
31
28
32
29
20
17
10
11
11
11
11
39
38
20
33
12
12a
2
17
4

FIG. 3
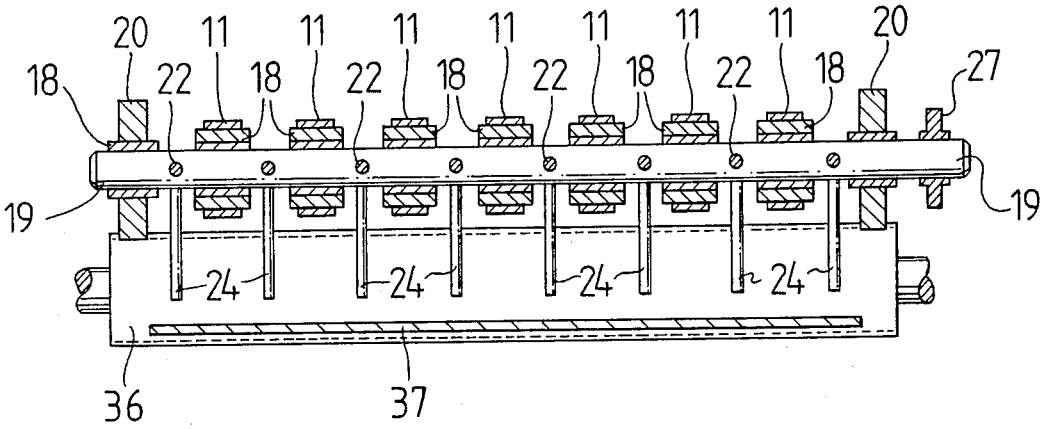
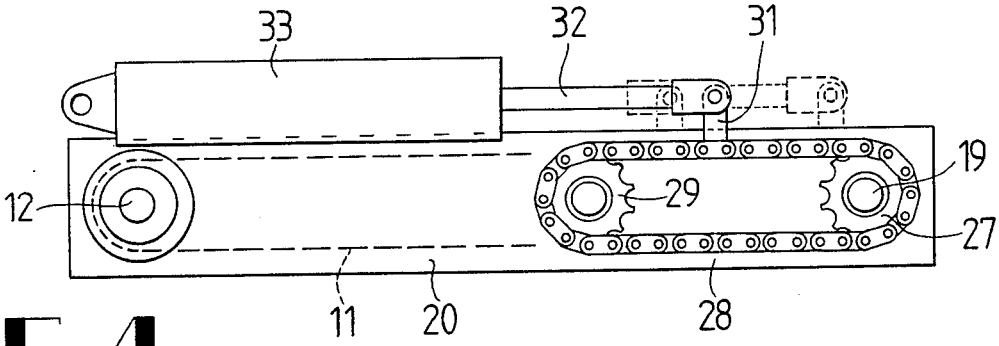
FIG. 4
FIG. 5
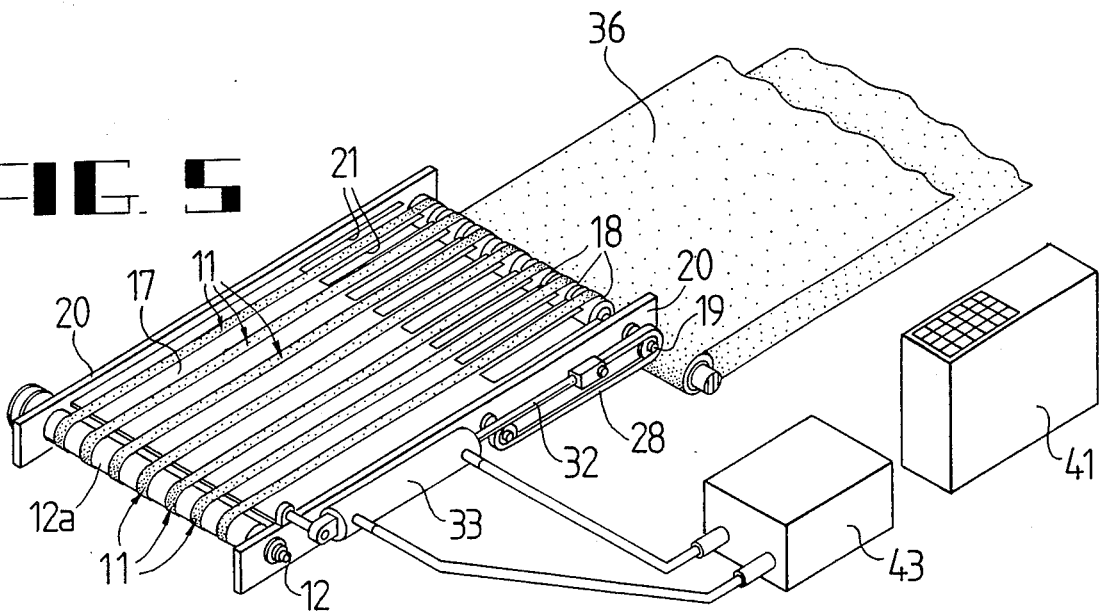

METHOD AND APPARATUS FOR SENSING THE PREFERRED SIDE OF GARMENT PORTIONS

FIELD OF THE INVENTION

The present invention relates to the field of garment manufacture and more particularly to the field of automated garment manufacture wherein garment portions are processed on continuously moving endless belt conveyors. In even greater particularity, the present invention may be described as an apparatus for detecting whether a garment portion moving along such a conveyor is right side up and inverting such garment portions which are not right side up.

BACKGROUND OF THE INVENTION

Garment manufacturing is an increasingly competitive industry wherein numerous innovations have been made in an effort to reduce the per garment labor and time expenditure. In order to improve productivity, many aspects of garment production have been automated. For example, it is common practice to use automated sewing machines to stitch a seam along one side of a garment. In so doing, the appropriate garment portions are placed on a conveyor which carries the portions through the sewing head where the actual sewing takes place. As may be readily understood, the proper placement and alignment of the garment portions on the conveyor is amajor requirement for successful operation of such automated machinery. Oftentimes garment portions are placed on the conveyor system from stacks of pre-cut garment portions. Each garment portion in the stack is supposedly in its proper face up or face down position for further processing; however, it sometimes occurs that during the cutting or stacking process a garment portion is stacked in an improper face up or face down position and succeeding garment portions are stacked thereon using the improperly positioned garment as a reference. When this occurs, the automated machinery produces a quantity of defective garments, each having at least one portion sewn in with the wrong side out. Such occurrences can be extremely costly and are not easily prevented by the equipment operators in a garment making assembly line.

SUMMARY OF THE INVENTION

It is the object of the present invention to identify garment portions which have been positioned in an improper face up or face down position prior to sewing the portion into a garment.

It is the further object of the present invention to reposition such garment portions as are identified to a proper face up or face down position.

In achieving the foregoing object, my invention attains its principal object which is to reduce the number of garment portions improperly sewn into garments and thereby improve the productivity and quality control of the automated garment manufacturing process.

BRIEF DESCRIPTION OF THE DRAWINGS

Apparatus embodying features of my invention are depicted in the accompanying drawings which form a portion of this disclosure and wherein:

FIG. 3 is a sectional view taken along line 3—3 of FIG. 1;

FIG. 4 is a side elevational view taken along line 4—4 of FIG. 1;

FIG. 5 is a partial perspective view of the apparatus;

DESCRIPTION OF A PREFERRED EMBODIMENT

Figure 1:
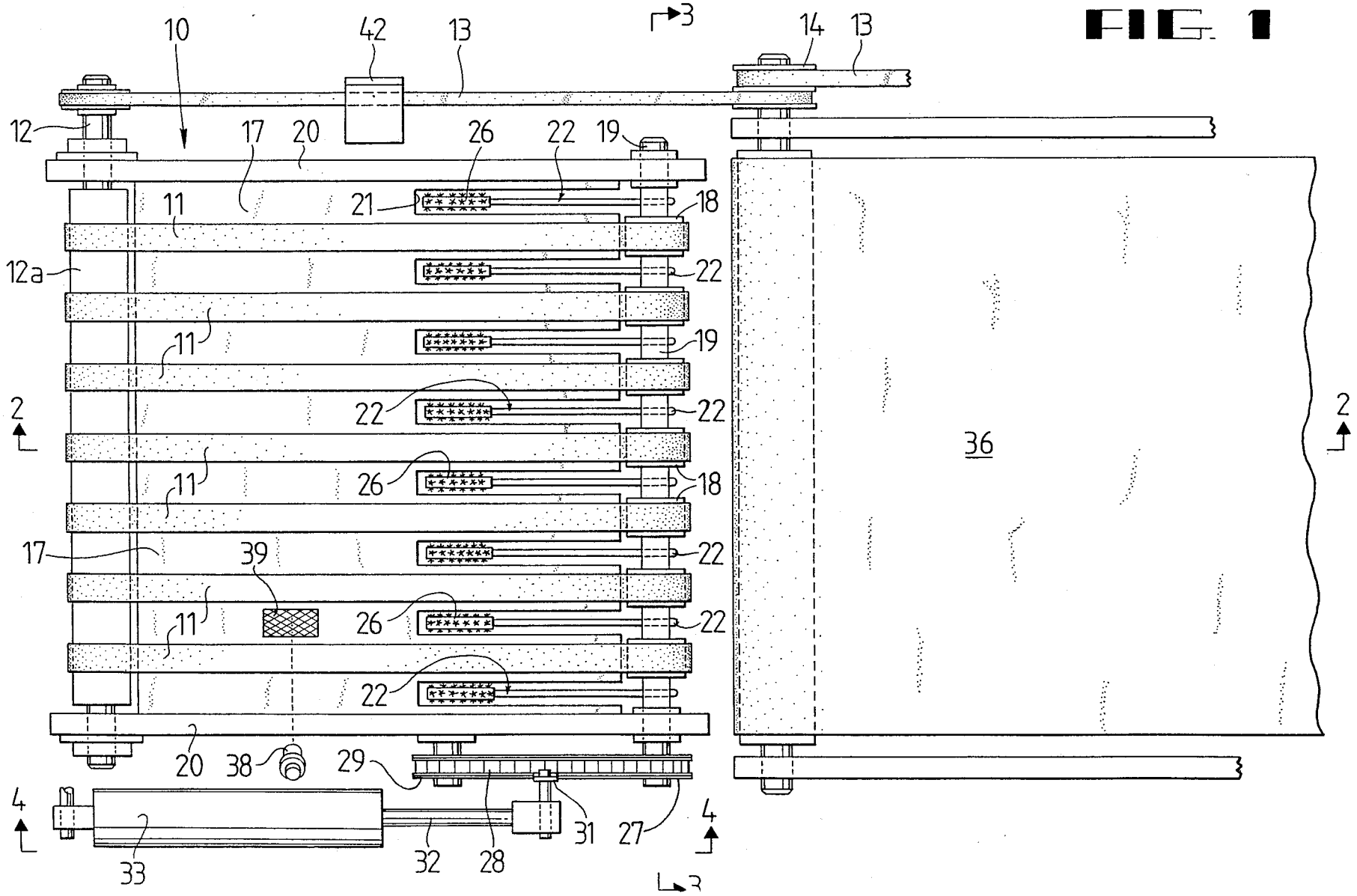
FIG. 1 is a top plan view of my invention at the junction of a pair of garment portion conveyors.

Referring to the FIGS. for a better understanding of my invention, it should be noted that in automated garment making machines, the garment portions are typically carried on endless belt conveyors. In FIG. 1, my invention is integrated into what will be called a screening conveyor 10, which comprises a plurality of parallel and spaced apart endless belt conveyors 11 which are concomitantly driven by a drive shaft 12 and roller **12*a*, which in turn is driven by a plurality of belts 13 and pulleys 14 from a conventional source of power, not shown. The conveyors 11 pass over a support plate 17 and a plurality of end rollers 18 rotatably mounted on a shaft 19. The support plate 17 has a plurality of slots 21 formed thereon intermediate the roller 18 and opening toward shaft 19. A plurality of generally L-shaped members 22 are affixed to the shaft 19 such that a major portion 23 is aligned beneath each slot 21 and a minor portion 24 extends downwardly substantially tangent to shaft 19. Although FIGS. 1–3 and 6–9 illustrates a true L-shaped member, it should be noted that the member 22 may actually partially encircle the shaft 19 to support the major and minor portions 23 & 24 and may not be a true L. Nonetheless, the rollers 18 extend radially beyond any curvature of members 22 about shaft 19 which is supported in bearing sidewall 20. It will be noted that major portion 23 carries a cloth engaging portion 26, whereas minor portion 24** is smooth for reasons which will become apparent hereafter.

As shown most clearly in FIGS. 1 and 4, shaft 19 has affixed to one end thereof a sprocket 27 about which an endless chain 28 is engaged. The chain 28 passes over an idler sprocket 29. Intermediate sprockets 27 and 28 a drive link 31 of chain 28 is connected to the output shaft 32 of a linear actuator 33. The actuator 33 is a multiposition device used to move the link 31 to one of a number of preselected positions thereby rotating the shaft 19, and displacing the members 22 through a predetermined arc. It will be appreciated that the chain 29 may be replaced by a mechanical linkage and actuator 33 may be replaced by a reversible electrical motor with the important criterion being that the shaft 19 must be selectively movable through a predetermined arc in either direction.

Figure 2:
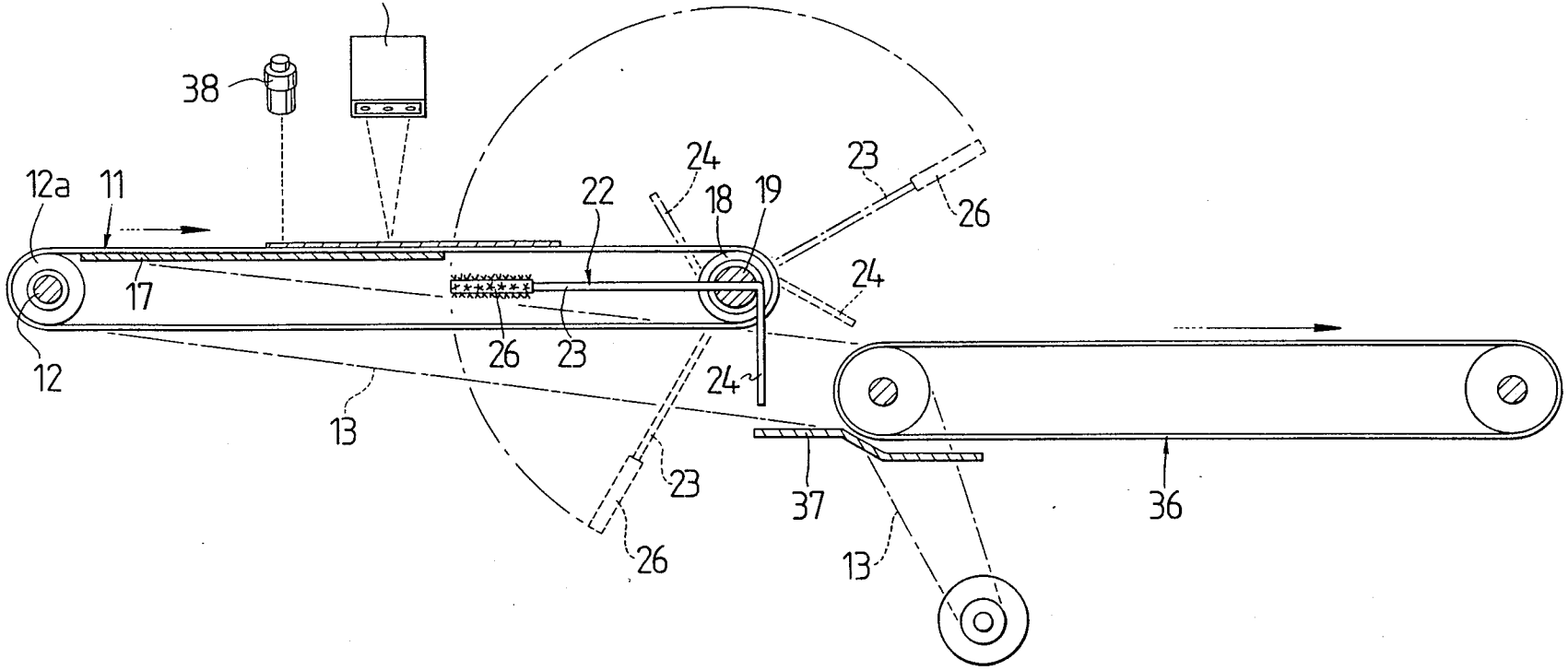
FIG. 2 is a sectional side elevational view taken along the centerline of the conveyor as shown in FIG. 1.
Figure 6:
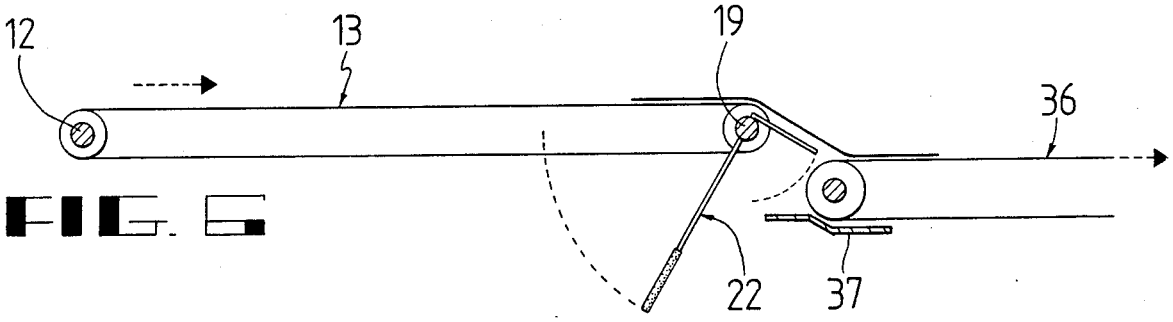
FIG. 6 is a side elevational representation of the apparatus in position to pass a properly positioned garment portion.

As seen in FIG. 2, the minor portion 24 of member 23 is of sufficient length to pass adjacent the surface of a secondary conveyor 36 located downstream of and slightly below the screening conveyor 10. The major portion 23 is long enough to extend outwardly over secondary conveyor 36 when rotated to its full displacement from the rest position shown in solid line in FIG. 2. Secondary conveyor 36 may be a wide belt conveyor having a surface that is somewhat less than smooth such that garment portions overlying the conveyor are positively urged therealong on the belt. As also may be seen in FIG. 2, a shelf 37 extends beneath the conveyors 11 and the conveyor 36.

With reference to FIGS. 1 and 2, it may be seen that we employ a photoelectric switch 38 such as an OMRON model No. E3F-R2C4 mounted above the screening conveyor 10. A retro-reflecting target 39 is formed on the support plate 17, by paint or tape as is well known, in position to cooperate with switch 38 such that a garment portion carried by the conveyor 10 will pass through the optical path betwen the switch 38 and target 39. The switch 38 will provide an electrical signal indicative of the passage of the leading edge and trailing edge of the garment portion. This electrical signal serves an an input to a microprocessor control unit 41 such as a GE series one programmable controller. Our invention also utilizes a photo detector 42 to ascertain whether the garment portion has been properly placed on the conveyor 10.

It should be understood that the garment portions processed by this machinery have a "right" side and a "wrong" side. On the right side the weave of the fabric is presented at 90° to the weave on the wrong side. Thus, one of the sides when viewed from a selected point, will appear as a plurality of fibers aligned perpendicular to the line of sight, whereas the other side will appear as a plurality of fibers aligned parallel to the line of sight. Light incident to the surface of the fabric at an acute angle will thus be reflected differently depending which side of the fabric the light strikes. The photo detector 42 is positioned to transmit a beam of light (e.g. infrared) onto the garment portions at an acute angle, and to detect the amount of light reflected from the garment portions. As noted hereinabove, the amount of light reflected will differ depending on whether the garment is "right" side up or "right" side down. The photo detector 42, which may be a "Smarteye" ®, Model SAL by Tri Tronics of Tampa, Fla., provides an electrical signal which indicates the amount of light reflected and thus the face up or down position of the garment portion to control unit 41.

The control unit 41 is operatively connected to control a hydraulic drive unit 43 which in turn controls the actuator 33. Thus, the control unit 41 is responsible for positioning the L-shaped members. In operation, the control unit 41 is programmed to coordinate the movement of the L-shaped members 22 in accordance with the speed of the conveyor and the signals provided by the switch 38 and photodetector 42. Each garment portion is individually screened to insure that its "right" side is up. The L-shaped members 22 may be positioned in a rest position as shown in solid line in FIGS. 2 and 7. When the control unit 41 receives a signal indicating a leading edge has passed switch 38, it then looks for a signal from detector 41 indicating whether the garment portion is properly positioned. If the garment portion is properly positioned, the control unit 41 causes the actuator 33 to move the L-shaped member 22 into position shown in FIG. 6 such that the minor portion supports the garment portion as it is discharged from the screening conveyor 10 onto conveyor 36. The control unit includes a timer which measures the time elapsed relative to leading edge and trailing edge signals received from switch 38 to determine when to return the L-shaped member to the rest position.

Figure 7:
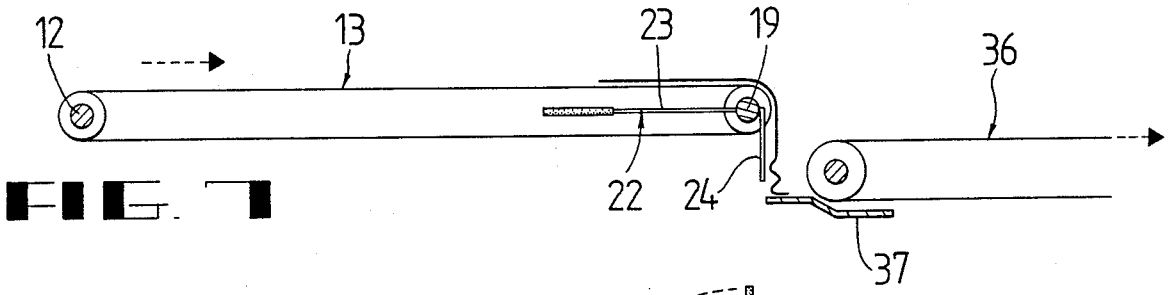
FIGS. 7, 8 and 9 are a series of side elevational representations of the apparatus in the process of repositioning an improperly placed garment portion.
Figure 8:
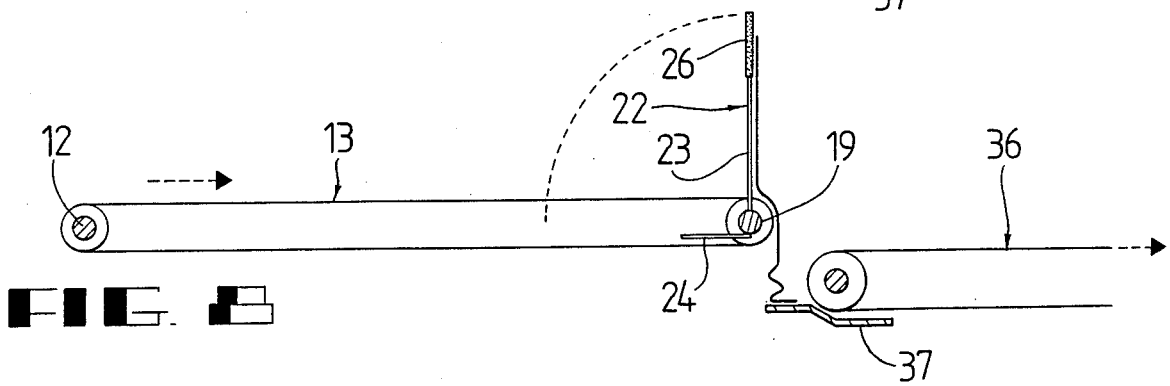
Figure 9:
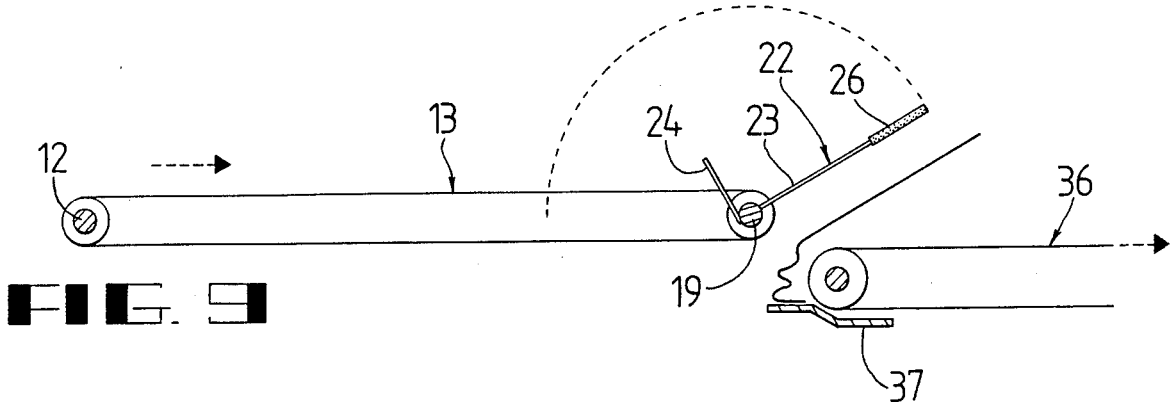

If the signal from photodetector 42 indicates that the garment portion is not right side up, the controller unit 41 causes the L-shaped members 22 to remain in the rest position, whereupon the garment portions begin to accumulate on shelf 37 as shown in FIG. 7. When sufficient time has elapsed for approximately half of the garment portion to pass over the rollers 18, the control unit 41 causes the actuator 33 to rapidly drive the chain 31 forward, thus causing the major portion 23 to rotate upwardly and forwardly between the conveyors 11 thereby lifting the trailing portion of the garment portion from the conveyor and rapidly carrying it forward as shown in FIGS. 8 & 9. When the major portion 23 stops in the position shown in FIG. 9, the momentum of the garment portion carries it onto the conveyor 36 which then pulls the remainder of the garment portion off of shelf 37. The L-shaped members 22 are rapidly returned to the rest position before the next garment portion reaches the slots 21.

It may be seen that the garment portion has now been inverted and has the proper side up for attachment. It will also be appreciated that by flipping the garment portion in this manner, the part carried forward by the L-shaped members is caused to occupy the position on conveyor 36 which was left vacant at the garment portion accumulated on shelf 37, thus the spacing of the garment portions remains essentially uniform and the conveyors run continuously, regardless of the face up or face down condition of any garment portion.

While I have shown my invention in one form, it will be obvious to those skilled in the art that it is not so limited but is susceptible of various changes and modifications without departing from the spirit thereof.

What I claim is:

1. Apparatus for processing fabric garment portions having a preferred side and a non-preferred side selected in accordance with the weave of the fabric comprising:

(a) first means for detecting whether said preferred side is face up or face down;

(b) second means for detecting the leading and trailing edge of said garment at a predetermined point as it moves along a conveyor;

(c) means for selectively inverting a garment as it is discharged from said conveyor; and (d) control means responsive at selected time intervals to said first and second detecting means for controlling said inverting means.

2. Apparatus as defined in claim 1 wherein said first means for detecting comprises a photoelectric detector having an output responsive to the amount of light reflected by said garment portion in a selected direction.

3. Apparatus as defined in claim 2 wherein said second means for detecting comprises a photoelectric detector positioned to detect the presence or absence of a garment portion at a location in said conveyor and having an output indicator thereof.

4. Apparatus as defined in claim 3 wherein said control means comprises a microprocessor having an input from each of said means for detecting and an output to said means for selectively inverting said garment portion, with said microprocessor being programmed to actuate said means for selectively inverting at a predetermined time to invert or pass said garment portion in accordance with the output signals of said first and second detecting means.

5. Apparatus as defined in claim 4 wherein said conveyor comprises a plurality of parallel spaced apart conveyor elements concomitantly driven about an endless path between an intake end and a discharge end of said conveyor and wherein said means for selectively inverting comprises:

(a) a plurality of generally L-shaped members affixed to a common shaft extending transversely of said conveyor elements at said discharge end with each L-shaped member located adjacent at least one of said conveyor elements; and (b) drive means affixed to said shaft for rotation of said L-shaped members to a garment portion passing position and for rotating said shaft rapidly such that said garment portion is lifted proximal the trailing end by said L-shaped members and carried forwardly to another conveyor for further processing.

6. Apparatus as defined in claim 5 wherein said L-shaped member includes a major leg disposed generally upstream of said discharge end and a minor leg extending generally downwardly and forwardly from said shaft relative to said conveyor with said major leg having fabric engaging members affixed thereto.

7. Apparatus as defined in claim 6 wherein said drive means selectively positions said minor leg in a non-fabric- engaging position and a fabric-engaging position whereat said minor leg extends forwardly of said conveyor discharge end and supports properly positioned garment positions subsequent to discharge thereof from said conveyor.

8. Apparatus as defined in claim 7 further comprising a garment collecting means positioned beneath the discharge end of said conveyor for partially supporting improperly positioned garment portions as they are discharged from said conveyor.

9. Apparatus as defined in claim 1 wherein said conveyor comprises a plurality of parallel spaced apart conveyor elements concomitantly driven about an endless path between an intake end and a discharge end of said conveyor and wherein said means for selectively inverting comprises:

(a) a plurality of generally L-shaped members affixed to a common shaft extending transversely of said conveyor elements at said discharge end with each L-shaped member located adjacent at least one of said conveyor elements; and (b) drive means affixed to said shaft for rotation of said L-shaped members to a garment portion passing position and for rotating said shaft rapidly such that said garment portion is lifted proximal the trailing end by said L-shaped members and carried forwardly to another conveyor for further processing.

10. Apparatus as defined in claim 9 wherein said control means comprises a microprocessor having an input from each of said means for detecting and an output to said means for selectively inverting said garment portion, with said microprocesor being programmed to actuate said means for selectively inverting at a predetermined time to invert or pass said garment portion in accordance with the output signals of said first and second detecting means.

11. Apparatus as defined in claim 9 wherein said L-shaped member includes a major leg disposed generally upstream of said discharge end and a minor leg extending generally downwardly and forwardly from said shaft relative to said conveyor with said major leg having fabric engaging members affixed thereto.

12. Apparatus as defined in claim 11 wherein said drive means comprises an actuator for rotating said shaft through a predetermined arc to position said minor leg forwardly of said discharge end of said conveyor to support properly positioned garment portions as they are discharged and for rapidly rotating said shaft through an arc having the same angular sense as the movement of said conveyor such that the trailing half of said garment portion is lifted and urged forwardly by said major leg.

13. Apparatus as defined in claim 12 wherein said actuator is a bi-directional linear actuator operably connected to said shaft.

14. Apparatus as defined in claim 12 wherein said actuator is a bi-directional electric motor.

15. A method for the processing of garment portions on a continuously moving conveyors comprising the following steps:

(a) determining the orientation of the garment portion as right side up or wrong side up based on the reflection of light from said fabric at a predetermined angle;

(b) detecting the passage of the leading edge of garment portions determined to be wrong side up at a predetermined point relative to the end of said conveyor;

(c) allowing a predetermined part of said garment portion to accumulate adjacent the end of said conveyor; and (d) rotating a plurality of garment portion engaging fingers upwardly and forwardly through openings in said conveyor to lift and throw the trailing edge of said garment portion forwardly into engagement with a second conveyor such that the trailing edge becomes the leading edge and the accumulated part is drawing onto said second conveyor in a right side up position.

16. A method for the processing of garment portions on a continuously moving first and second conveyor comprising the following steps:

(a) determining the orientation of the garment portion as right side up or wrong side up based on the reflection of light from said fabric at a predetermined angle;

(b) rotating a plurality of garment portion supporting members into position extending forwardly of said first conveyor such that the garment portions determined to be right side up are supported intermediate said first and second conveyors; and (c) inverting garment portions determined to be wrong side up as they are discharged from said conveyor.

17. Apparatus for detecting and positioning a woven garment portion in a preferred orientation comprising:

(a) a plurality of parallel spaced apart endless belt conveyors mounted for synchronous movement;

(b) first means for detecting the leading and trailing edge of a garment portion carried by said conveyors relative to a predetermined position;

(c) second means for detecting the orientation of fibers in the weave of said garment portion;

(d) means for selectively inverting a garment portion as it is discharged from said plurality of conveyors; and (e) control means receiving input from said first and second means for activating said means for selectively inverting said garment portion at a selected time.

18. Apparatus as defined in claim 17 wherein said means for inverting comprises:

(a) a plurality of generally L-shaped members mounted in parallel on a common shaft with each member disposed adjacent at least one of said conveyors;

(b) drive means for rotating said shaft to move said members selectively between a garment portion inverting position and a non-inverting position.

19. Apparatus as defined in claim 18 further comprising an output conveyor positioned proximal the discharge end of said plurality of conveyors and separated therefrom by a predetermined distance; a cloth receiving tray mounted beneath the space between said plurality of conveyors and said output conveyors, with said L-shaped members having a minor leg with a length sufficient to support a garment between said plurality of conveyors and said output conveyor and a major leg having a length sufficient to extend beyond said space between said plurality of conveyors and said output conveyor, with each major leg having a fabric engaging portion on the end thereof.

20. Apparatus as defined in claim 19 wherein said drive means comprises a multi-position drive unit adapted to position said L-shaped members at a disengaged position such that the garment portion is not contacted by the L-shaped members, a pass position whereat the garment portions are supported thereby as they are discharged from said conveyors, and adapted to urge said shaft in the direction of motion of said conveyors such that said L-shaped members are urged upward between said conveyors through an arc in excess of 90° at a speed substantially in excess of the linear speed of said plurality of conveyors.

* * * * *